US005557852A

United States Patent [19]

Frisina

[11] Patent Number: 5,557,852

[45] Date of Patent: Sep. 24, 1996

[54] HAND TOOL WITH FIVE CUTTING EDGES

[76] Inventor: Giacomo Frisina, P.O. Box 655, Newman Lake, Wash. 99025

[21] Appl. No.: 454,688

[22] Filed: May 31, 1995

[51] Int. Cl.[6] ..... B25D 3/00

[52] U.S. Cl. ..... 30/167; 30/353

[58] Field of Search ..... 30/167, 168, 167.1, 30/167.2, 314, 315, 353; 125/41

[56] References Cited

U.S. PATENT DOCUMENTS

| | | | |
|---|---|---|---|
| 637,463 | 11/1899 | Hegarty | 30/167 |
| 1,280,786 | 10/1918 | McConnell | 30/167 |
| 2,083,123 | 6/1937 | Quick | 30/167 |
| 2,542,582 | 2/1951 | Schwork | 30/353 |
| 2,813,278 | 11/1957 | Stecher | 30/353 |
| 3,942,591 | 3/1976 | Brannin | 30/353 |
| 4,592,113 | 6/1986 | Selfors | 30/167 |

FOREIGN PATENT DOCUMENTS

| | | | |
|---|---|---|---|
| 1429297 | 3/1976 | United Kingdom | 30/167 |

*Primary Examiner*—Hwei-Siu Payer
*Attorney, Agent, or Firm*—David S. Thompson

[57] ABSTRACT

A woodworking hand tool providing a blade having five cutting edges is disclosed. The blade provides an elongate front cutting edge, shorter left and right cutting edges, and left and right rear cutting edges. The blade is operative if moved in any direction, as a result of the five cutting edges. A shaft having a first end attached to the blade and a second end attached to a handle, is bent slightly, allowing the tool to be used more effectively and comfortably.

1 Claim, 2 Drawing Sheets

HAND TOOL WITH FIVE CUTTING EDGES

BACKGROUND OF THE INVENTION

A number of woodworking tools are known for a variety of purposes. However, the prior art has failed to provide a tool having a blade having five cutting edges that is suitable for use in cutting wood by either a forward-and-back motion or a side-to-side motion. The prior art has failed to provide a woodworking tool having a blade having five cutting edges that cooperate in a manner that allows the user to make cut after cut on a work piece using first one of the five cutting edges and then another in a rapid manner. As a result, no prior art woodworking tool provides a blade having five cutting edges that allows the user to make cuts in a work piece in an almost continuous manner, even though the direction of movement of the tool is constantly changing. In contrast to the prior art, the instant invention provides a tool having a blade having five cutting edges to give a user greater speed and precision in accurately removing wood from a work piece.

SUMMARY OF THE INVENTION

The present invention is directed to an apparatus that satisfies the above needs. A novel woodworking tool is provided that provides five cutting edges and allows the user to make a variety of cuts with greater control and ease that was previously possible.

The wood-working hand tool of the present invention provide:

(a) A blade with five cutting edges. The blade with five cutting edges of the instant woodworking tool provides a front cutting edge, a left cutting edge, a right cutting edge, a left rear cutting edge and a right rear cutting edge. The blade also provides a front blade surface, left and right triangular surfaces, left and right rear blade surfaces, and a bottom surface.

(b) A shaft having a flat body portion is attached to the blade having five cutting edges. The shaft separates the left rear cutting edge from the right rear cutting edge, and attaches to the blade between the left and right rear blade surfaces. The shaft provides forward and rearward bolt holes, for attachment to the handle.

(c) A handle attaches to the shaft, so that the user may easily manipulate the tool. The handle provides similar upper and lower pieces having forward and rearward bolt holes that may be fastened together, holding the shaft between them. The handle provides a flared front portion and a bulbous rear portion, to allow a user's hand to comfortably fit in a central grip portion.

It is therefore an object and an advantage of the present invention to provide a novel woodworking hand tool that fits comfortably in a user's hand.

It is a further object and an advantage of the present invention to provide a novel woodworking hand tool that provides a blade having five cutting edges.

It is a further object and advantage of the present invention to provide a novel woodworking hand tool that makes cuts when being moved either forward or backward.

It is a further object and advantage of the present invention to provide a novel woodworking hand tool that may be used to make cuts to the left or right side of the tool.

It is a further object and advantage of the present invention to provide a novel woodworking hand tool that is able to precisely shave thin pieces of wood from a work piece.

It is a further object and advantage of the present invention to provide a novel woodworking hand tool that allows a user to work rapidly with precise control.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figures 1, 2, 6:
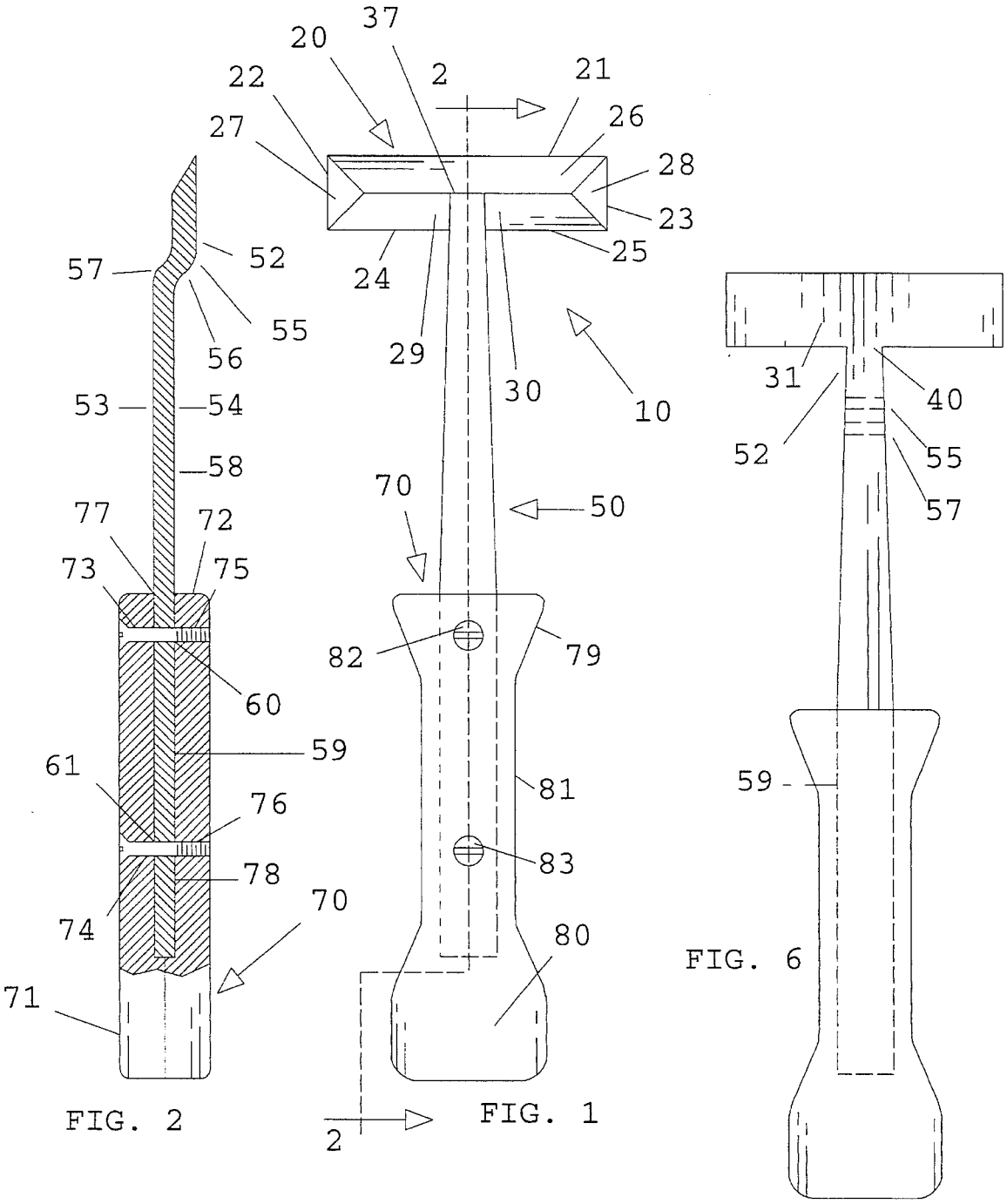
FIG. 1 is a top view of a version of the tool of the invention.
FIG. 2 is a side partial cross-sectional view of the tool of FIG. 1, along the 2—2 lines.
FIG. 6 is a bottom view of the version of the invention of FIG. 1.

Referring in particular to FIGS. 1–4 and 6, a woodworking hand tool 10 having a blade with five cutting edges constructed in accordance with the principles of the invention is seen. The hand tool generally provides a blade 20 having five cutting edges, a shaft 50 attached to the blade, and a handle 70 attached to the end portion of the shaft opposite the blade.

As seen in FIGS. 1 through 6, a blade 20 provides a front cutting edge 21, a left cutting edge 22, a right cutting edge 23, a left rear cutting edge 24 and a right rear cutting edge 25.

The blade 20 also provides a front blade surface 26, left and right triangular surfaces 27, 28, a left rear blade surface 29, a right rear blade surface 30, and a bottom surface 31. Blade surfaces 26–30 are generally planar or slightly concave. Bottom surface 31 is generally planar.

The blade 20 also provides an upper ridge edge 32 that is somewhat shorter than the length of the blade 20. Left forward angled edge 33 connects the upper ridge edge 32 with the front cutting edge 21 and the left cutting edge 22. Right forward angled edge 34 connects the upper ridge edge 32 with the front cutting edge 21 and the right cutting edge 23. Left rearward angled edge 35 connects the upper ridge edge 32 with the left rear cutting edge 24 and the left cutting edge 22. Right rearward angled edge 36 connects the upper ridge edge 32 with the right rear cutting edge 25 and the right cutting edge 23.

Figure 4:
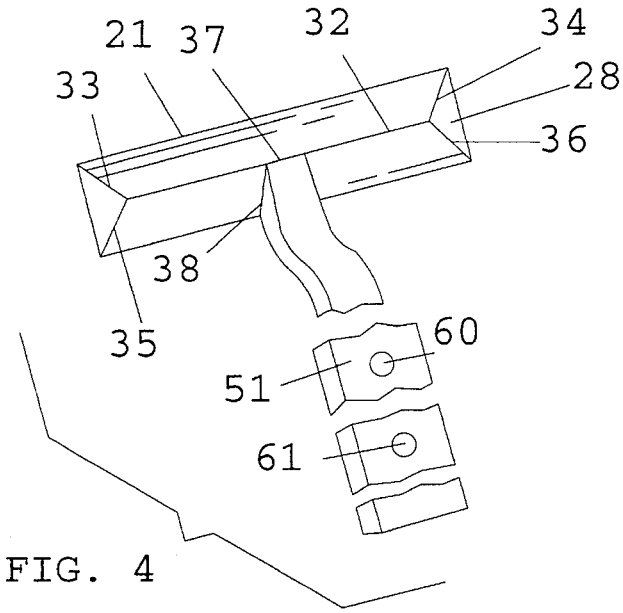
FIG. 4 is a view of the blade and several portions of the shaft of the tool of FIG. 1.
Figure 3:
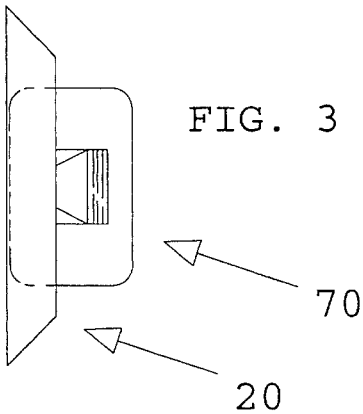
FIG. 3 is a front end view of the tool of FIG. 1.

In the preferred embodiment blade 20 attaches to the shaft 50, as seen in FIGS. 1 and 4, by means of welding. In the second species 100, seen in FIG. 5, the blade 101, the shaft 102, and the handle 103 are made in a unitary manner, and the entire tool is typically cast in steel. A shaft-to-blade upper junction line 37 is best seen in FIGS. 1 and 4. A left shaft-to-blade junction line 38 is seen in FIG. 4. A right shaft-to-blade junction line 39 is seen in FIG. 2. A shaft-to-blade lower junction 40 is seen in FIG. 6.

The preferred embodiment of the blade 20 of the invention has the following dimensions: The length of the blade 20, from left cutting edge 22 to right cutting edge 23 is two and one-half inches; the width of the blade 20 from front cutting edge 21 to either rear cutting edge 24, 25 is five-eights of an inch; and the thickness of the blade 20, from bottom surface 31 to upper ridge edge 32 is three-sixteenths of an inch. The length of the rear cutting edges 24, 25 is approximately one and one-eighth inches.

As seen in particular in FIG. 1, a shaft 50 connects the blade 20 to the handle 70. The shaft provides a flat body portion 51, having a forward end 52 that is attached to blade 20 and a rear end portion 59 that is inserted into handle 70. As seen in the cross-sectional view of FIG. 2, the flat body 51 has an upper side 53 and a lower side 54.

Figure 5:
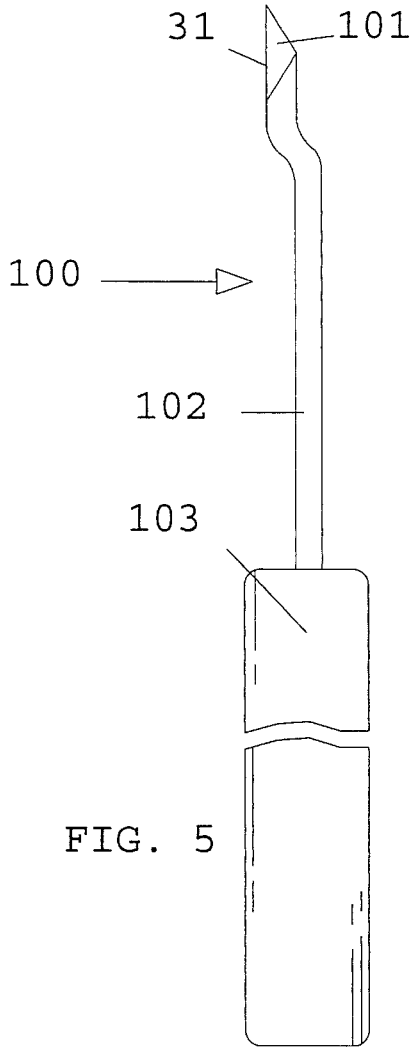
FIG. 5 is a side view of a second version of the tool of the invention, having a unitary construction, in which the blade, shaft, and handle are all formed of a single piece of material.
Figure 7:
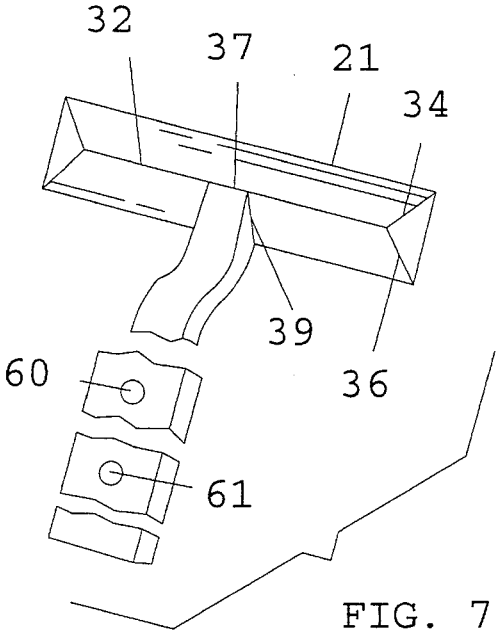
FIG. 7 is a view of the blade and several portions of the shaft of the tool of FIG. 1.

The shaft is not straight in the preferred embodiment, as seen in FIGS. 2, 4, and 5. A lower curved portion 55 is bent upwardly about 45 degrees, as seen in FIG. 2. A transition portion 56 is typically quite short—usually less than an inch in length. An upper curved portion 57 is bent downwardly by approximately 45 degrees. A straight middle portion 58 is typically about two inches long. A rear end portion 59 is inserted into the handle 70. The rear end portion 59 of the shaft 50 provides a forward bolt hole 60 and a rearward bolt hole 61 that aid in fastening the shaft 50 to the handle 70, by means of bolts 82, 83, as will be seen.

The preferred embodiment of the shaft 50 of the invention has the following dimensions: The length of the shaft 50 is six inches, three inches of which are inserted into handle 70. The width of shaft 50 is one half inch at the front opening 77 of the handle 70, and tapers as seen in FIG. 1, to approximately one-fourth of an inch near blade 20.

The blade 20 and the shaft 50 are typically made from stainless steel, but may be made from other materials, if desired.

As seen in particular in FIGS. 1 and 2, a handle 70 is formed from an upper piece 71 and a lower piece 72. The upper piece 71 provides a forward bolt hole 73 and a rearward bolt hole 74. Similarly, the lower piece provides a forward bolt hole 75 and a rearward bolt hole 76. Bolt holes 73–76 allow the upper and lower pieces to be attached together by forward bolt 82 and rearward bolt 83, or other similar fasteners. When the upper and lower pieces 71, 72 are joined, an axial cavity 78 having a front opening 77 is provided to carry shaft 50 as seen in FIG. 2. The axial cavity 78 tends to be rectangular in cross-section, as is required to carry the shaft 50, as seen in perspective view in FIG. 4.

The handle of the preferred embodiment provides a flared front portion 79 and a bulbous rear portion 80, as seen in FIGS. 1 and 6. The flared front 79 and bulbous rear portion 80 tend to keep a user's hand on the central grip portion 81, which is sized to provide a comfortable grip for a typical user.

The handle 70 is typically made of wood, but may also be made of plastic or other suitable material. The preferred embodiment of the handle 70 of the invention has the following dimensions: The length of the handle is six inches; the preferred thickness is three-fourths of an inch; and the width of the handle at flared and bulbous ends 79, 80 is one and three-eighths inches. The height of axial cavity 78 is three-sixteenth of an inch, the width of that cavity is one-half inch; and the length of axial cavity 78 is three inches.

In operation, the central grip portion 81 of the handle 70 of hand tool 10 is grasped by a user. The handle 70 is then moved in a manner causing the blade 20 to contact a wooden work piece. A forward motion of the tool 10 causes the front cutting edge 21 of blade 20 to cut the work piece. The work piece may either be etched or shaved, as desired. Similarly, rearward movement of the tool 10 causes left rear cutting edge 24 and right rear cutting edge 25 to remove material from the work piece. Left and right cutting edges 22, 23 may also be used to cut and shape a wooden work piece.

It is a primary object and advantage of the present invention to provide a novel woodworking hand tool that provides a blade having five cutting edges. The five cutting edges cooperate in a manner that allows the user to make cut after cut on a work piece using first one of the five cutting edges and then another in a rapid manner. The blade having five cutting edges allows the user to make cuts in a work piece in an almost continuous manner, even though the direction of movement of the tool 10 is constantly changing.

It is a further advantage of the present invention to provide a novel woodworking hand tool that makes cuts when being moved either forward or backward and that may be used to make cuts to the left or right side of the tool.

It is a further advantage of the present invention to provide a novel woodworking hand tool that is able to shave thin pieces of wood from a flat surface, or to make deep cuts, depending on what is required by the work piece and job.

Although the present invention has been described in considerable detail and with reference to certain preferred versions, other versions are possible. For example, a variety of dimensions and materials could be used to construct the disclosed tool. Therefore, the spirit and scope of the appended claims should not be limited to the description of the preferred versions disclosed here.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A hand tool for use in woodworking, comprising:

(I) a blade, comprising:
- (a) a front cutting edge;
- (b) a left cutting edge, adjacent to the front cutting edge;
- (c) a right cutting edge, adjacent to the front cutting edge;
- (d) a left rear cutting edge, adjacent to the left cutting edge; and
- (e) a right rear cutting edge, adjacent to the right cutting edge;

(II) a shaft, attached to the blade, comprising:
- (a) a body portion having a forward end attached to the blade and having a rearward end;
- (b) a lower curved portion;
- (c) a transition portion, attached to the lower curved portion;
- (d) an upper curved portion, attached to the transition portion;
- (e) a middle portion, attached to the upper curved portion; and
- (f) a rear end portion, attached to the middle portion, having a forward bolt hole and a rearward bolt hole; and (III) a handle, attached to the rearward end of the shaft by a forward bolt and a rearward bolt, comprising:

(a) an upper piece, having a forward bolt hole and a rearward bolt hole, and also having a flared front portion and a bulbous rear portion and a central grip portion;

(b) a lower piece, having a forward bolt hole and a rearward bolt hole, and also having a flared front portion and a bulbous rear portion and a central grip portion, attached to the upper piece;

(c) an axial cavity surrounding the rearward end of the body portion of the shaft; and (d) a front opening in the axial cavity through which the shaft passes.

* * * * *